US005228406A

United States Patent [19]

Marini et al.

[11] Patent Number: 5,228,406

[45] Date of Patent: Jul. 20, 1993

[54] SUBSEA EXPLORATION APPARATUS

[75] Inventors: Jean Marini, Marly Le Roi; Fernand Gledel, Orsay; Marcel Tardivon, Linas; Alain Brisse, Paris, all of France

[73] Assignees: Framatome, Courbevoie; Mors S.A., Paris, both of France

[21] Appl. No.: 804,400

[22] Filed: Dec. 10, 1991

[30] Foreign Application Priority Data

Dec. 10, 1990 [FR] France ..... 90 15438

[51] Int. Cl.[5] ..... B63G 8/14

[52] U.S. Cl. ..... 114/331; 441/29; 60/496

[58] Field of Search ..... 114/312, 313, 330, 331, 114/333, 321, 322, 334, 25, 121; 73/170 A, 170 R; 441/21, 23, 28, 29; 60/496, 495

[56] References Cited

U.S. PATENT DOCUMENTS

| | | | |
|---|---|---|---|
| 3,242,740 | 3/1966 | Niskin | 114/333 |
| 3,570,437 | 3/1971 | Davis, Jr. | 114/333 |
| 3,952,349 | 4/1976 | Erath et al. | 114/331 |
| 3,964,266 | 6/1976 | Bartlett | 114/333 |
| 4,202,036 | 5/1980 | Bowditch et al. | 364/420 |
| 4,493,281 | 1/1985 | Coleman | 114/333 |
| 4,692,906 | 9/1987 | Neeley | 441/29 |
| 4,938,164 | 7/1990 | Onofri | 114/333 |

*Primary Examiner*—Joseph F. Peters, Jr.
*Assistant Examiner*—C. T. Bartz
*Attorney, Agent, or Firm*—Pollock, Vande Sande & Priddy

[57] ABSTRACT

This subsea exploration apparatus comprises a ballast tank and a shuttle (7) with a watertight enclosure (10) which contains instrumentation for measurement, control and transmission of signals to a surface buoy. The enclosure is guided along a cable (1) fixed to the ballast tank and is provided with a chamber (26) whose lower opening is equipped with a hatch (29). When the shuttle is in high position, a load of ballast is transferred from the tank (5) into the chamber (26), causing the shuttle to descend. This load is jettisoned in a low position of the shuttle, by opening the hatch (29), in order to permit it to reascend.

11 Claims, 3 Drawing Sheets

SUBSEA EXPLORATION APPARATUS

FIELD OF THE INVENTION

The present invention relates to subsea exploration apparatus of the type comprising a shuttle for carrying out round trips along a guide cable between two predetermined levels, high and low.

BACKGROUND OF THE INVENTION

In apparatuses of this type, the shuttle is designed to carry out autonomously during a relative long period, for example a year, round trips between two predetermined levels, for example one round trip per day. During these movements, an on-board item of instrumentation, supplied by batteries of accumulators also contained in the shuttle, carries out measurements of various parameters of the environment, e.g., force of the subsea currents, water temperature, etc. Some shuttles are equipped to transmit corresponding signals to a floating buoy which retains the upper end of the cable, and the buoy in turn, retransmits its information to orbiting satellites.

One essential problem concerning these shuttles resides in its propulsion means. In fact, driving by means of a motor would lead to an excessive volume of batteries of accumulators.

SUMMARY OF THE INVENTION

The subsea exploration apparatus according to the invention, in order to solve this problem particularly simply and economically, comprises a ballast tank, integral with the cable at a predetermined high level, provided at its lower portion with an outlet opening which can be selectively shut off by a shutoff device, and the shuttle comprises:

watertight enclosure containing an item of measurement, control and, possibly, signal transmission instrumentation and a source of electrical current for such instrumentation;

means for guiding the enclosure along the cable;

a chamber, integral with the enclosure at least for the movements along the cable, provided at its upper end with a loading opening and at its lower end with a discharge opening which can be selectively shut off by a hatch;

means for transferring, at the high level of the shuttle, a predetermined load of ballast from the outlet opening of the tank to the loading opening of the chamber; and means for selectively opening the hatch of the chamber.

According to other characteristics:

the chamber forms part of a fairing mounted so as to be freely rotatable about the cable;

the fairing is integral with the enclosure;

the loading opening the chamber is annular, of coaxial with the cable, the outlet opening of the tank being offset in relation to the cable axis;

the shutoff device is a metering device, especially having two superposed valves;

the shuttle furthermore comprises a permanent ballast, in normal operation, and means for jettisoning such permanent ballast:

the guiding means comprise rollers rolling on the cable and connected to reversible motors which may function either as generators delivering into a variable load or as driving motors;

the enclosure contains an induction coil which surrounds the cable, and means for supplying the coil with electrical current whose intensity varies with the speed of the shuttle;

the shuttle comprises, on the outside, a watertight volume, one wall of which is elastically deformable under the effect of the external pressure;

the shuttle comprises adjustable flaps mounted for rotation about a horizontal axis.

BRIEF DESCRIPTION OF THE DRAWINGS

Exemplary embodiments of the invention will now be described with reference to the attached drawings, in which:

FIG. 1 is a schematic view of the shuttle in longitudinal cross-section;

DESCRIPTION OF PREFERRED EMBODIMENT

Figure 1:
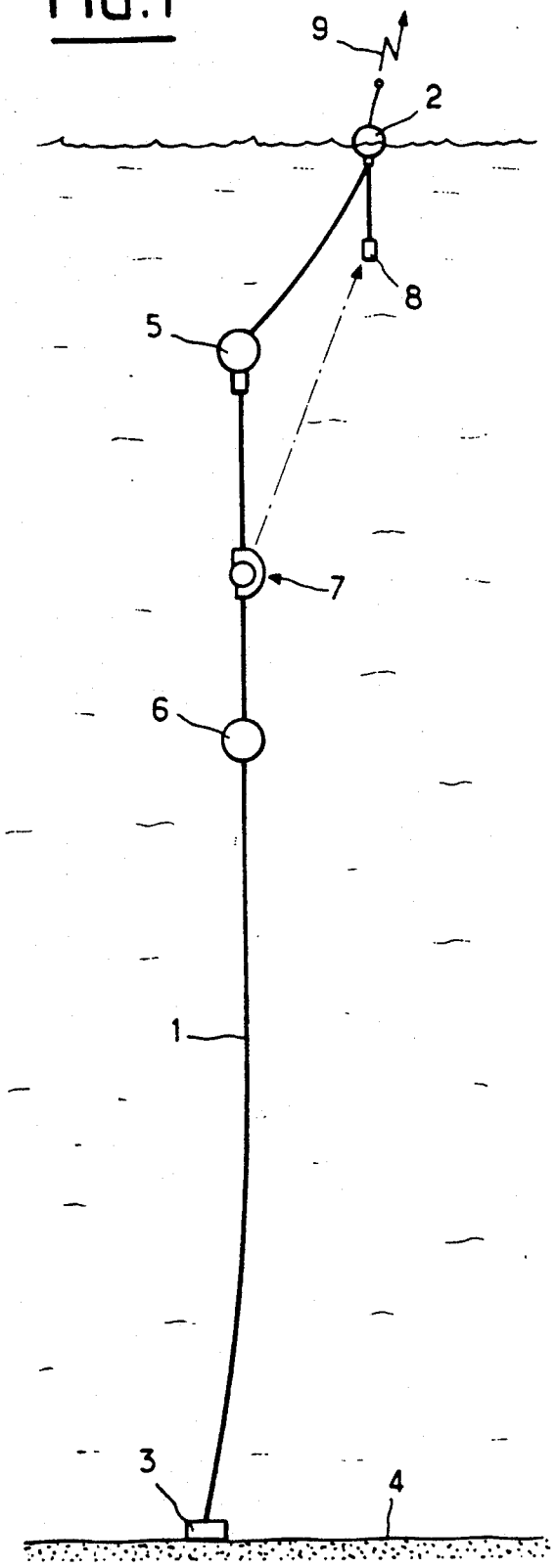
FIG. 1 is a general view of an oceanographic research system comprising an apparatus in accordance with the invention.

The oceanographic research system shown in FIG. 1 comprises a cable 1 made of steel clad with an appropriate plastic, stretched approximately vertically between a surface buoy 2 and a mooring 3 anchored to the seabed 4. Two floats are fixed to this cable, namely an upper float 5 forming a ballast tank and a lower float 6. By way of example, the float 5 may be at −50 meters and the float 6 at −1000 meters, with a seabed at −5000 meters.

A shuttle 7 is guided along the cable 1 between the two floats. It is, for example, intended for carrying out a round trip from the float 5 to the float 6 and conversely every 24 hours during a year, the duration of each round trip being of the order of 2 hours. As illustrated by the dot-dash line, the shuttle 7 contains an item of electronic instrumentation which enables it to send acoustic signals representative of the measurements which it carries out to a receiver 8 integral with the buoy 2, and the latter comprises means for retransmitting this data to an orbiting satellite, as represented by the arrow 9.

Figure 2:
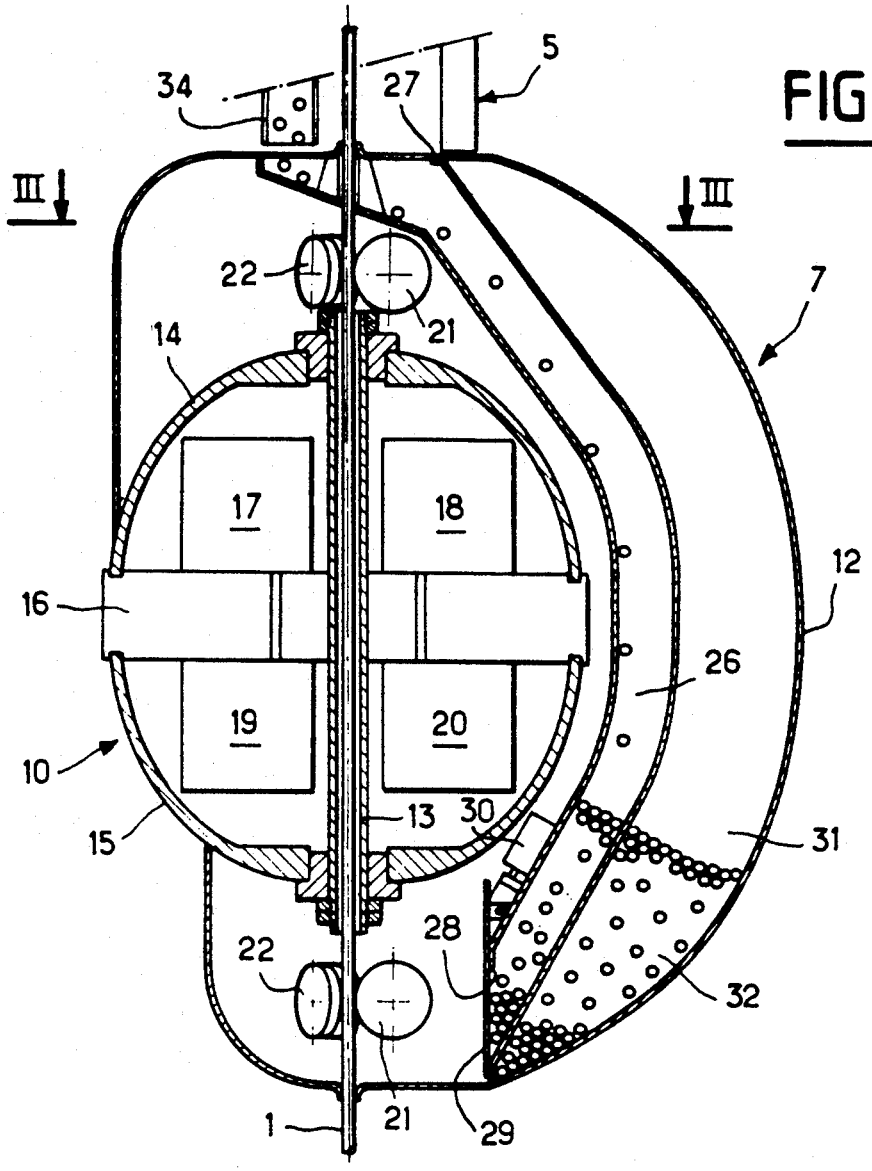
Figure 3:
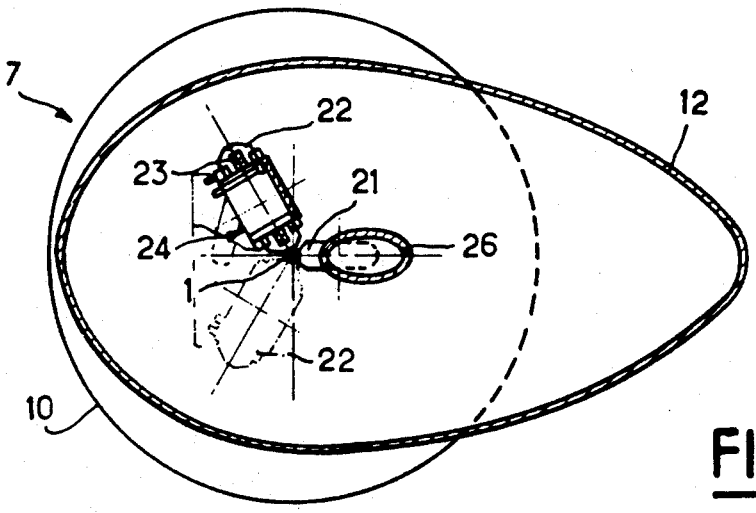
FIG. 3 is a cross-section view along the line III—III of FIG. 2.

FIGS. 2 and 3 show the arrangement of the shuttle, some mechanical linkage means having been omitted for the sake of clarity. Shuttle 7 essentially comprises a watertight enclosure 10 and a fairing 12.

The enclosure 10 comprises a hollow shaft 13 traversed, with clearance, by the cable 1, and upper 14 and lower 15 hemispheres connected to each other by a cylindrical spacer 16. To the latter are fixed a battery of accumulators 17, an item of electronic instrumentation 18 comprising sensors appropriate for measuring the speed of the shuttle along the cable and the desired physical parameters, and means for transmitting acoustic signals to the buoy 2, speed regulating means 19 and movement control means 20 comprising a time-delay processor.

To the enclosure 10 are connected, by appropriate means, two sets of guide rollers, respectively upper and lower guide rollers, disposed at 120° to each other and rolling on the cable 1. Each set comprises, a pressure roller 21 and, on the other hand, two regulating rollers 22 each of which contains permanent magnets 23 forming part of a reversible motor 24.

The fairing 12, which is firmly connected to the enclosure 10 and is of hydrodynamic form, surrounds and protects the two sets of rollers and a significant portion of the enclosure 10. This fairing is crescent-shaped in elevation (FIG. 2), and ovoid-shaped in plan view (FIG. 3), and has holes at its upper and lower ends for the passage of the cable 1. The assembly of the fairing and of the enclosure, i.e., the shuttle assembly, may pivot freely about the axis of the cable in the manner of a weather-vane.

A first chamber 26 of generally tubular shape is delimited in the fairing 12. At its upper end, located above the upper set of rollers, this chamber is terminated by an annular opening 27 surrounding the cable. The chamber 26 follows the contours of the enclosure 10 and, beneath the latter, it is terminated by a discharge opening 28 which can be shut off selectively by a hatch 29 controlled by an electromagnet 30.

The fairing 12 delimits a second chamber 31 which contains a permanent ballast 32. Means (not shown) enable this ballast to be jettisoned for an emergency ascent of the shuttle.

The float 5 (FIGS. 1, 2, 4 and 5) constitutes a tank of granular ballast 33 which may consist of any appropriate material, for example metal balls. This tank comprises a lower vertical appendage which defines an outlet tubing 34, slightly offset in relation to the axis of the cable 1, in which are mounted two spaced apart valves, namely, upper valve 35 and lower valve 36. These valves, which as shown in FIG. 5, may be of the tubular diaphragm type and can be flattened by inflation by means of a compressed gas contained in the float, delimit between them, in the tubing 34, a volume which defines a predetermined load of ballast.

The operation of the shuttle is the following.

Figure 4:
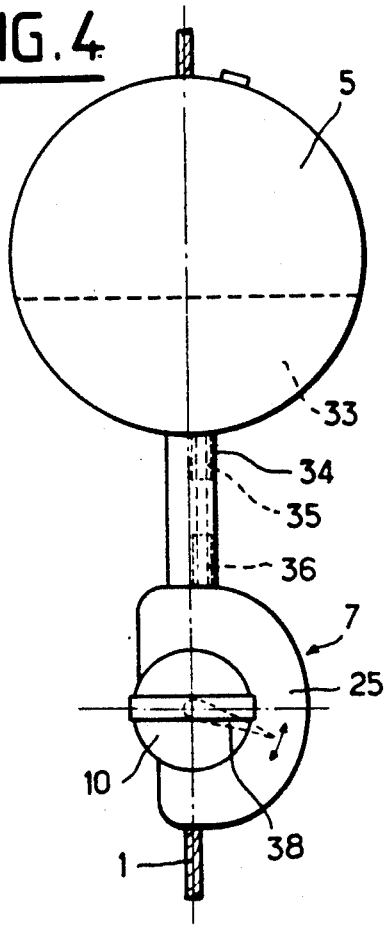
FIG. 4 shows, in elevation, the apparatus according to the invention in a high position of the shuttle.
Figure 5:
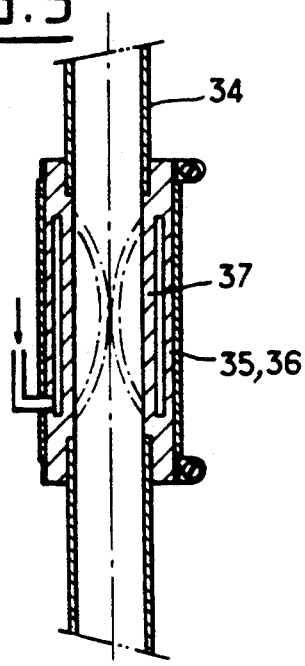
FIG. 5 is a view, in longitudinal cross-sectional and on a larger scale, of a detail of FIG. 4.

At rest, the shuttle is located in a high position, bearing against the lower appendage 34 of the float 5, as illustrated in FIG. 4. The hatch 29 is opened, the first chamber 26 is empty of all ballast, the valves 35 and 36 are closed and enclose between them a load of ballast, following the previous opening/closing of the two valves. Regardless of the angular position of the shuttle, imposed by the direction of the current, the outlet opening of the tubing 34 is located opposite the annular opening 27 of the first chamber 26.

When the descent is to start, the hatch 29 is closed and the valve 36 is opened. The load of ballast therefore falls into the first chamber 26 and is retained therein by the hatch 29. The shuttle, thus made heavier, descends. Its speed is regulated by the reversible motors 24 which function as dynamos, the regulating means 19 being adapted in order to cause the load, into which these motors deliver, to vary as a function of the speed of movement measured by the instrumentation 18 so as to obtain an appropriate braking effect.

If this effect appears insufficient, the control means 20 open the hatch 29 briefly in order to allow a small quantity of ballast to escape.

When the shuttle is in a low position, in contact with the lower float 6, and has to reascend, the electromagnet 30 is actuated in order to open the hatch 29, and, thus, jettison the load of ballast contained in the chamber 26. The regulation of the speed during the ascent is carried out as previously. If, as a result of the accumulation of foreign matter on the cable, the shuttle is stopped or slowed down excessively, this is detected by the instrumentation 18 and the regulating means 19 supply the electrical current to the motors 24 which then operate temporarily as driving motors.

Because of the sea currents, it may happen that the cable is curved sufficiently between the floats 5 and 6 is order for the resistance to the descent to increase noticeably in the lower region of the travel of the shuttle. In order to maintain the speed of the latter constant, it is then desirable to provide the shuttle with means for varying its hydrodynamics or its buoyancy.

According to a first embodiment, these means are constituted by ailerons 38, indicated by dot-dashed lines in FIG. 4, articulated about a horizontal axis. The control means 20 are then adapted in order to modify the inclination, and therefore the lift, of these ailerons.

Figure 6:
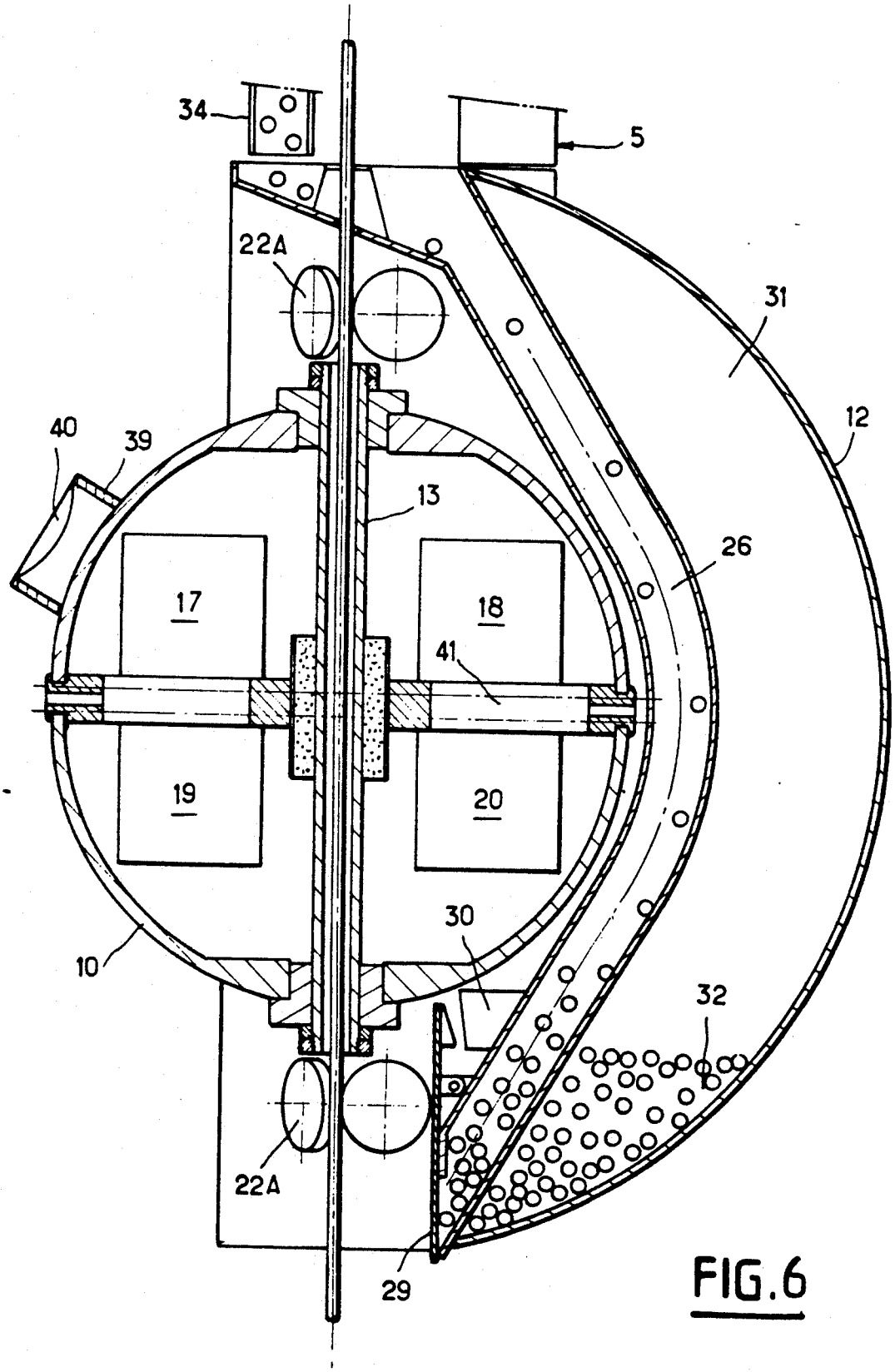
FIG. 6 is a view similar to FIG. 2 of a variant of the shuttle.

Another possibility, illustrated in FIG. 6, consists in providing the outside of the shuttle with an auxiliary cavity 39, for example a cylindrical cavity, one wall 40 of which, in contact with the water, is elastically deformable under the effect of the pressure, this wall being, for example, constituted by a flexible membrane as shown, or by a piston loaded by a spring. Progressively with the descent, wall 40 is pushed in, which reduces the buoyancy which is exerted on the shuttle.

The two above-mentioned means may be combined. The variant shown in FIG. 6 differs in essence from the previous variant only by the speed regulating means used: the rollers 22 of FIGS. 2 and 3 are replaced by pressure rollers 22A and the spacer 16 contains an induction coil 41 coaxially surrounding the central tube 13. During the movement of the shuttle, an electric current is sent to the coil by the regulating means 19 and induces eddy currents in the cable 1. The electric current is regulated as a function of the measured speed so as to produce appropriate braking by means of eddy currents.

I claim:

1. Subsea exploration apparatus comprising a shuttle for carrying out round trips along a guide cable between predetermined high and low levels, and a ballast tank integral with said guide cable at said predetermined high level, said ballast tank having a lower portion with an outlet opening which can be selectively shut off by a shutoff device, said shuttle comprising (a) a watertight enclosure containing instrumentation and a source of electrical current for said instrumentation;

(b) means for guiding said enclosure along said cable;

(c) a chamber integral with said enclosure, at least for movements along said cable, said chamber having an upper end with a loading opening and a lower end with a discharge opening which can be selectively shut off by a hatch;

(d) means for transferring, at said high level of said shuttle, a predetermined load of ballast from said outlet opening of said ballast tank to said loading opening of said chamber; and (e) means for selectively opening said hatch of said chamber.

2. Apparatus according to claim 1, wherein said chamber forms part of a fairing mounted for free rotation about said cable.

3. Apparatus according to claim 2, wherein said fairing is integral with said enclosure.

4. Apparatus according to claim 2, wherein said loading opening of said chamber is annular and has an axis coincident with said cable, said outlet opening of said ballast tanks being offset in relation to said axis.

5. Apparatus according to claim 1, wherein said shut-off device is a metering device having two superposed valves.

6. Apparatus according to claim 1, wherein said shuttle further comprises a ballast which is permanent in normal operation, and means for jettisoning said ballast.

7. Apparatus according to claim 1, wherein said guiding means comprise rollers rolling on said cable and connected to reversible motors selectively functioning as generators delivering into a variable load and as driving motors.

8. Apparatus according to claim 1, wherein said enclosure contains an induction coil which surrounds said cable and means for supplying said induction coil with an electrical current whose intensity varies with a speed of said shuttle.

9. Apparatus according to claim 1, wherein said shuttle has an exterior comprising a watertight volume with a wall which is elastically deformable under external pressure.

10. Apparatus according to claim 1, wherein said shuttle comprises adjustable flaps mounted for rotation about a horizontal axis.

11. Apparatus according to claim 1, wherein said instrumentation comprises measurement, control and signal transmission equipment.

* * * * *